US005090080A

United States Patent [19]

Thuresson et al.

[11] Patent Number: 5,090,080

[45] Date of Patent: Feb. 25, 1992

[54] BRUSH HANDLE

[76] Inventors: Lars-Erik Thuresson, Vasagatan 12; Per-Gunnar Thuresson, Tulpangatan 10, both of, S-742 00 Östhammar, Sweden

[21] Appl. No.: 543,772

[22] PCT Filed: Jan. 26, 1989

[86] PCT No.: PCT/SE89/00021

§ 371 Date: Jul. 20, 1990

§ 102(e) Date: Jul. 20, 1990

[87] PCT Pub. No.: WO89/06919

PCT Pub. Date: Aug. 10, 1989

[30] Foreign Application Priority Data

Feb. 2, 1988 [SE] Sweden ..... 8800330

[51] Int. Cl.[5] ..... A46B 5/02; B25G 3/38

[52] U.S. Cl. ..... 15/143 R; 15/105; 15/145; 15/167.1; 15/176.1; 16/110 R; D4/104; D4/138

[58] Field of Search ....., 15/105, 110, 111, 145–148, 15/167.1–167.3, 173, 178, 176.1, 176.4, 176.5, 176.6, 216, 206, 143 R, 144 R; 30/85, 88, 329, 330, 334, 337; 81/177.6, 177.7; 119/94; 132/73, 75, 308, 309, 311, 321, 322, 328, 329, 76.2, 76.4, 76.5, 73.5; 401/88; D4/104–113, 127, 130–135, 138; 16/110 R; 128/62 A; 433/146,147,141

[56] References Cited

U.S. PATENT DOCUMENTS

| | | | |
|---|---|---|---|
| 51,819 | 1/1866 | Fiester | 15/178 |
| 57,320 | 8/1866 | Harroun, Jr. | 15/178 |
| 118,493 | 8/1871 | Smith | 15/178 |
| 568,267 | 9/1896 | McIver et al. | 15/178 |
| 809,690 | 1/1906 | Hunt . | |
| 887,682 | 5/1908 | Medbery . | |
| 930,149 | 8/1909 | Brown | 30/330 |
| 1,027,752 | 5/1912 | Nair . | |
| 1,684,855 | 9/1928 | Acheson | 15/167.1 X |
| 1,783,151 | 11/1930 | McArthur | 15/167.1 X |
| 2,529,399 | 11/1950 | Kruck | 15/144 R |
| 2,570,412 | 10/1951 | Vogel . | |
| 2,977,127 | 3/1961 | Mertes . | |
| 3,707,013 | 12/1972 | Erkers | 15/167.1 |
| 3,892,040 | 7/1975 | Marquis . | |
| 4,222,143 | 9/1980 | Tarrson et al. . | |
| 4,319,377 | 3/1982 | Tarrson et al. . | |
| 4,480,352 | 11/1984 | Eggett . | |
| 4,572,223 | 2/1986 | Rosenfeld | 132/309 |
| 4,710,996 | 12/1987 | Tarrson et al. | 15/105 |
| 4,712,266 | 12/1987 | Yamaki | 15/144 R |
| 4,780,923 | 11/1988 | Schultheiss | 15/111 |
| 4,805,646 | 2/1989 | Shimenkov | 132/321 |

*Primary Examiner*—Robert W. Jenkins
*Assistant Examiner*—C. Cooley
*Attorney, Agent, or Firm*—Witherspoon & Hargest

[57] ABSTRACT

The invention relates to a handle for receiving brushes or pencil brushes, especially interproximal tooth brushes, having a shaft portion and a brush or pencil brush portion. According to the invention the handle includes two elongated handle portions connected to each other through a folding joint provided between first ends thereof. Furthermore, a through-hole is provided in the folding joint for the insertion of the shaft portion of the brush or pencil brush therethrough. Gripping members are provided in connection with the hole for gripping the shaft portion, the handle portions are foldable towards each other about the folding joint and guide and/or locking members are provided for guiding the handle portions towards their correct mutual position in the folded condition and/or for locking the handle portions to each other in the folded condition.

9 Claims, 3 Drawing Sheets

BRUSH HANDLE

Figure 1A:
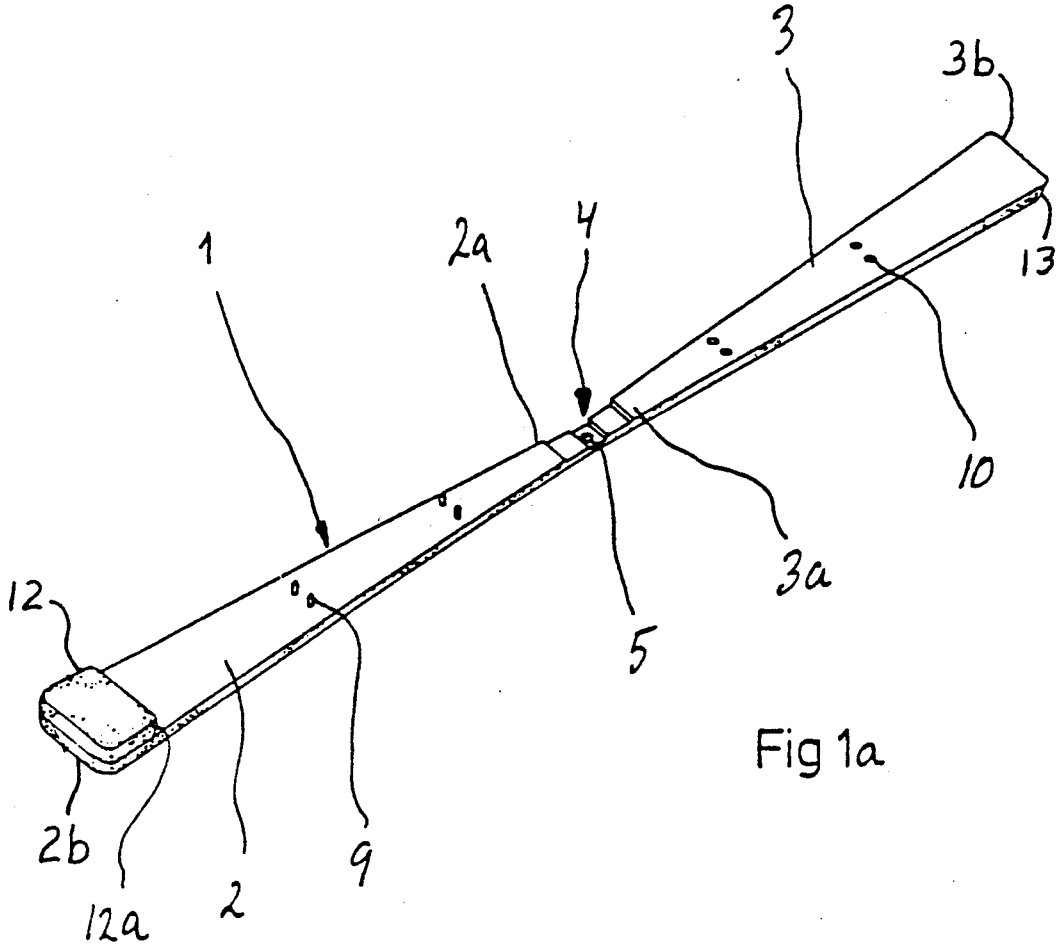

This application is based on International Application Number PCT/SE89/00021 filed on Jan. 26, 1989.

The present invention relates to a handle for receiving exchangable brushes or brush pencils having an elongated shaft portion and a brush or brush pencil portion provided at one end of the shaft portion, and especially relates to a handle for receiving interproximal tooth brushes or interdental tooth brushes.

Interproximal or interdental brushes are used for cleaning spaces between and under teeth, bridges and the like, and conventionally consist of twisted wires having bristles secured between the twisted wires. Although it is in many instances possible to hold the brush directly at its shaft portion when cleaning the teeth, there is, especially in connection with thin brushes having weak shafts, a demand for handles for such brushes, partly for permitting a firmer grip of the brush so that its weak shaft portion may be supported better, and partly for facilitating the handling of the brush during cleaning. Since the brushes are worn relatively quickly when used the handle should also be designed in such a way that the brush may be easily and quickly replaced.

In order to meet the above mentioned demands a number of handles of different structure have been developed, and the most commonly used handle is of the general type described for instance in U.S. Pat. No. 4,319,377. This known handle consists of an elongated metal body which is threaded at one end. At the threaded end a hole is provided transversely through the body, whereby the shaft portion of the brush is intended to be introduced into the hole, whereupon that part of the shaft portion which extends through the hole is bent down into a notch extended longitudinally of the body along and somewhat past the threaded portion, and finally a nut provided on the body is screwed up on the threaded portion in order to lock the brush to the handle. Apart from the fact that this known handle requires relatively substansive processing of two separate parts and accordingly is relatively expensive, it is also considered by many persons as clumsy and difficult to use. The method used for attaching the brush also results in considerable damage to the shaft portion of the brush, and since the nut presses directly on the shaft portion the latter tends to fold at this place during use. In other words, instead of stabilizing the brush the handle rather increases the tendency of the brush to fold.

Moreover a plastic handle having substantially the same function as the above described metal handle is known through U.S. Pat. No. 4,222,143. Instead of the threaded end and the nut cooperating therewith, the latter handle uses a plastic sleeve which is displaceable on the handle and which is pushed over that end of the shaft portion which is inserted through the hole of the handle and bent down. Finally the plastic sleeve is locked in said position by means of projections on the handle body. Although the last mentioned handle may probably be manufactured at a lower cost than the above described metal handle, it suffers from largely the same disadvantages as said metal handle. A further variation of the same basic structure as those described above, is known through U.S. Pat. No. 3,892,040 which describes a handle manufactured from plastic and provided at both ends with a thread which cooperates with a plastic nut for locking the brush. The difference is that in this case that portion of the shaft which is inserted through the handle is not bent down, but the complete brush is extended transversely in relation to the handle. However, in this case a special brush or alternatively an adapter must be used in order to prevent that the user injures himself on that part of the shaft portion which is extended through the handle. In closer detail the transversal hole in the handle body is formed having a considerably larger diameter than the twisted shaft portion and a plastic sleeve is attached to the shaft portion of the brush, said plastic sleeve is inserted into the transversal hole and covers and protects the projecting end of the shaft portion. Thus, compared to the above described handles, the last mentioned solution suffers from the further disadvantage that it can not be used together with any brush or requires a further adapter for the shaft portion of the brush.

Within this area there are finally also known different plastic handles having fixed, i.e. not replaceable interdental brushes. In such cases the brushes are either glued to the handles, press fit therein or molded into the handles during manufacturing.

Accordingly the object of the present invention is to provide a handle of the kind indicated in the introduction, which eliminates the above discussued shortcomings and which is simultaneously easy and inexpensive to manufacture.

This object is achieved by means of a handle of the kind indicated in the enclosed patent claim 1.

The depending subclaims are directed to advantageous embodimens of the invention.

Figure 1B:
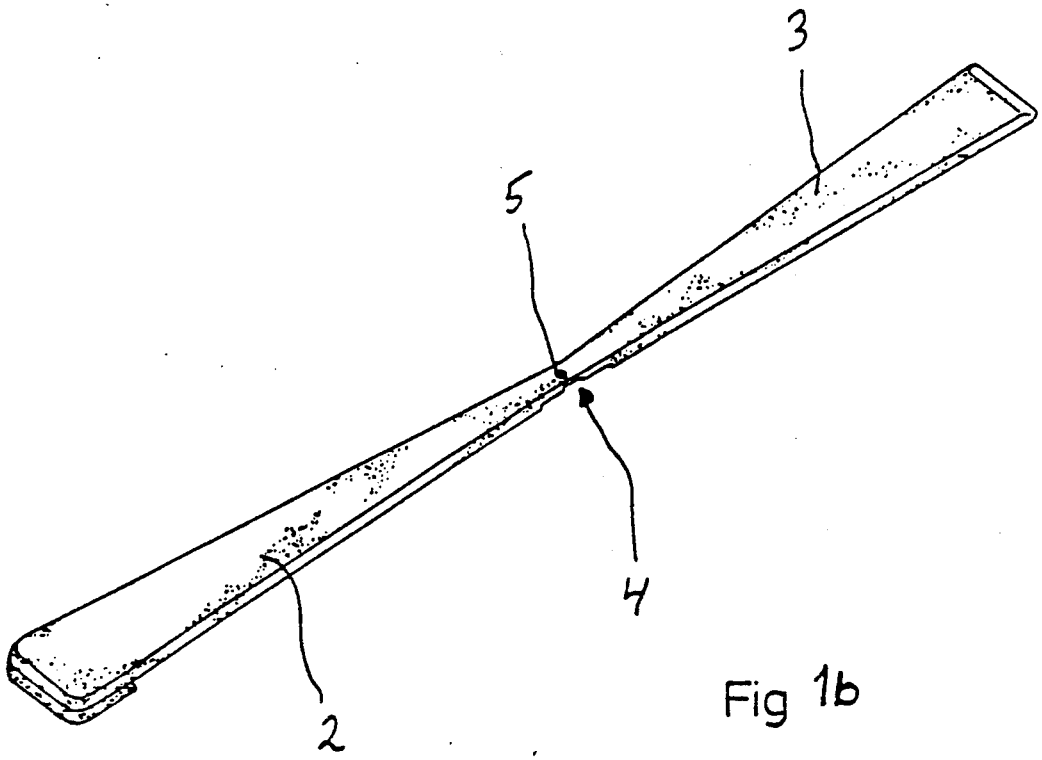
Figure 4:
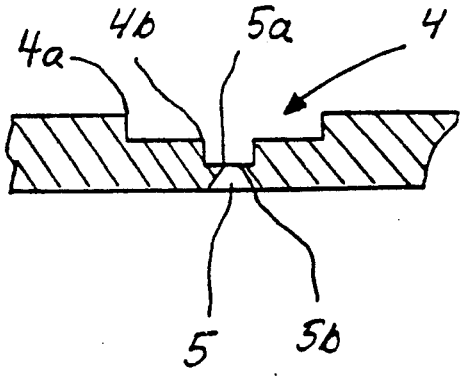
Figure 2:
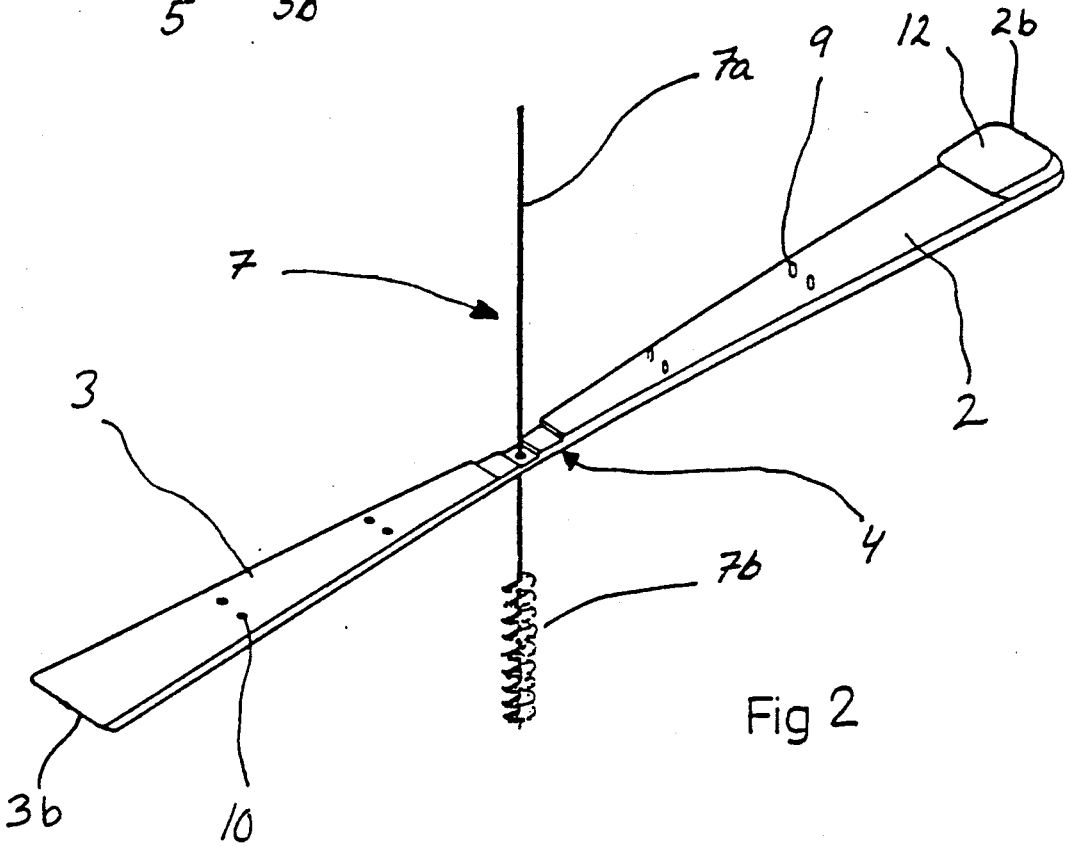
Figure 3A:
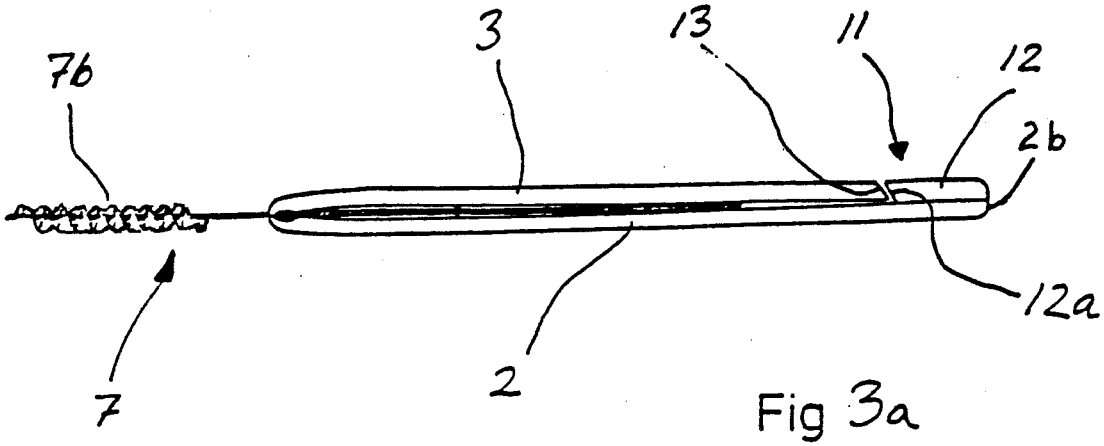
Figure 3B:
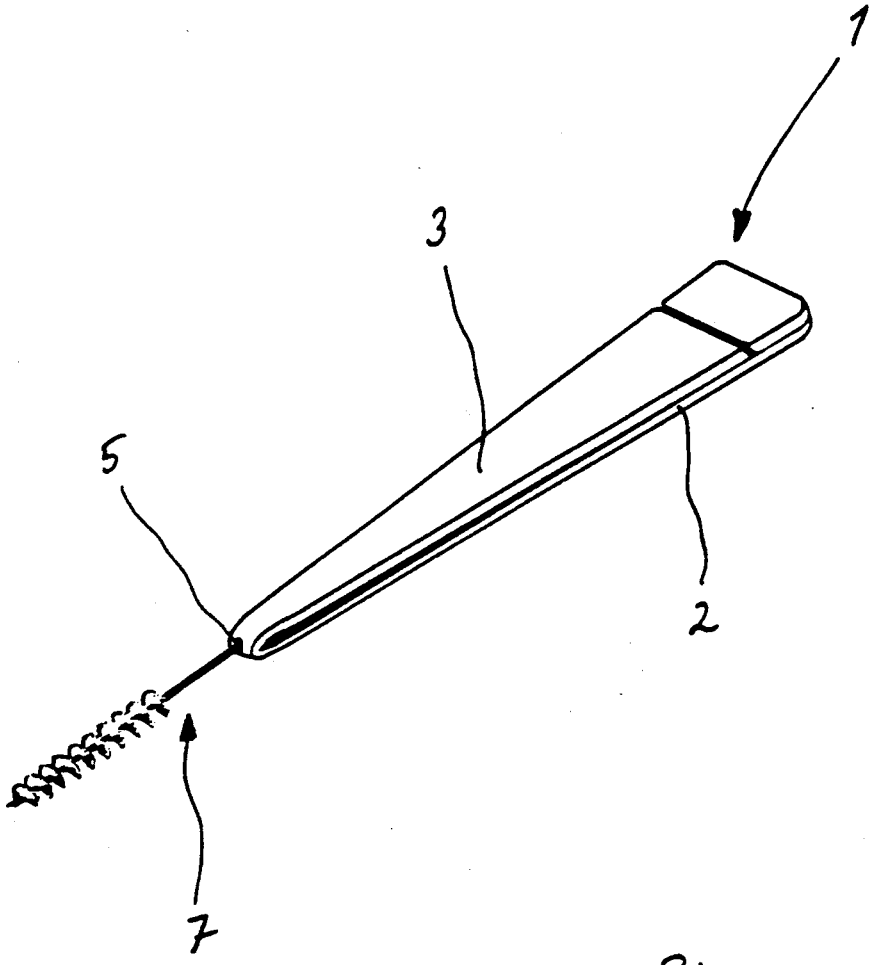

An embodiment of the invention is described more closely below in connection with the enclosed drawings, on which:

FIGS. 1*a* and 1*b* are perspective views from above and below, respectively of an embodiment of the handle according to the invention, FIG. 2 illustrates the handle according to FIG. 1 with a brush inserted therein and in a position before folding the portions of the handle, FIGS. 3*a* and 3*b* is a side view and a perspective view, respectively of the handle according to the invention in a folded and locked together condition and with the brush inserted, and FIG. 4 illustrates an enlarged cross-section through the folding joint.

In the embodiment illustrated in the drawings the handle 1 is manufactured in one piece from a suitable plastic material. The unitary handle basically consists of two handle parts 2, 3 connected to each other by means of a folding joint 4 provided between first ends 2*a*, 3*a* thereof. The handle parts 2, 3 are provided with such a thickness of material in relation to the selected plastic material that they have an adequate stiffness, i.e. so that they in their folded together condition are sufficiently stable to support and stabilize the brush, which will be described below, in the desired manner and to permit the user to get a good hold of these handle portions with his fingers. In the illustrated embodiment the folding joint 4 is formed through a weakening of the plastic material of the handle, and as is illustrated especially in FIGS. 1*a*, 2 and 4, the weakening is accomplished by removing material from the handle at one side thereof, and more specifically at the side thereof corresponding to the inner sides of the handle portions 2, 3, which sides face each other when the handle is folded (compare with FIGS. 3*a* and 3*b*).

A through-bore 5 is formed through the handle, centrally in the weakening 4, and the shaft portion 7*a* of the brush 7 (FIG. 2) is intended to be inserted through this bore 5 in order to be mounted in the handle 1, whereby the bristle portion 7*b* of the brush 7 extends past the handle in the assembled condition. In order to facilitate insertion of the shaft portion 7*a* of the brush 7 into the bore, this is preferably formed in such a way that it widens conically towards the end 5*b* thereof from which the portion 7*a* is inserted (FIG. 4). Due to this bore configuration a relatively sharp edge 5*a* is formed at the opposite end of the bore 5, and when the handle is folded 5 this edge 5*a* will work as a gripping means engaging the shaft portion 7*a* of the brush 7 in order to keep the brush fixed in the axial direction. In the illustrated embodiment (compare especially with FIG. 4) the weakening 4 is also stepped, having the maximum weakening adjacent the bore 5, whereby this configuration on one hand provides for a very advantageous folding joint where the folding in itself is concentrated in the desired manner to the area by the through-bore 5, and on the other hand causes the edges 4*a*, 4*b* of the steps to form further gripping means assisting in keeping the shaft portion 7*a* of the brush 7 in place.

Due to the described configuration of the gripping means an extremely firm axial locking of the brush 7 is achieved, which is essential since it is very important that the brush can not come loose from the handle during use. Otherwise the brush might be pulled out from or could be pushed completely into the handle during the cleaning of comparatively narrow spaces between teeth.

In this connection it shall also be mentioned that the above described configuration gives a further advantage when the handle according to the invention is used together with a conventional interdental brush which consists of twisted wires, as mentioned above. This is due to the fact that the gripping means 5*a*, 4*a*, 4*b* engage the windings of the twisted shaft portion and this permits that the length of the brush 7 protruding from the handle may be fine-adjusted after the handle has been folded and locked together. This is carried out by simply screwing out or screwing in the brush 7. The coarse adjustment of the length of the protruding portion is carried out by inserting a corresponding portion of the shaft of the brush through the bore 5 in connection with the assembly.

With reference to FIGS. 1*a* and 1*b* it is illustrated that the handle portions 2, 3 are preferably formed in such a manner that they taper from their free second ends 2*b*, 3*b* towards their first ends 2*a*, 3*a* adjacent the folding joint 4. Due to this configuration the handle 1 will in its folded condition have a shape that is advantageous with regard to the use thereof, since it will be sufficiently wide at the second ends 2*b*, 3*b* of the handle portions to provide a firm grip for the fingers and at the same time will not be bulky or unconveniently large in its end at the bristle portion 7*b* of the brush 7. FIG. 1*a* also illustrates that the handle portions 2, 3 at their sides facing each other in the folded condition, are provided with guide- and/or locking means in the shape of pegs or projections 9 and bores or recesses 10, respectively which are provided in pairs straddling the longitudinal axis of the handle portions. In the illustrated embodiment two pairs of the respective guide- and/or locking means are provided on each handle portion 2, 3 but this number may naturally be varied as desired.

With reference to FIG. 2 it is illustrated that the shaft portion 7*a* of the brush 7 is inserted through the bore 5 of the handle, whereby the shaft portion 7*a* is positioned between the pegs or projections 9 of the respective pair so that it is maintained in a fixed position at the handle portion 2 during and after the folding of the handle 1. During the final phase of the folding the pegs 9 enter the recesses 10 in the other handle portion 3 and guide the handle portions to their correct mutual position. Due to the fact that the pegs are formed having a somewhat larger dimension than the recesses, the handle portions are also to a certain extent locked together by the engagement between the pegs and recesses.

Naturally the guide- and/or locking means may be designed differently without departing from the present invention, and for instance the same function would be achieved by means of a longitudinal groove in one side of one of the handle portions 2 or 3, in which groove the shaft portion 7*a* of the brush 7 would be positioned, and a corresponding, elongated strip or ridge on the side of the other handle portion 3 or 2, which engages the groove when the handle 1 is folded.

In order to provide a safer locking together of the two handle portions 2, 3 in the folded condition, so that the user may put down the handle without risking that the handle portions 2, 3 go apart, the handle may also be provided with an auxiliary locking, preferably in connection with the second free ends 2*b*, 3*b* of the handle portions 2, 3. In the illustrated embodiment the auxiliary locking consists of a thickened portion 12 at the second free end 2*b* of one of the handle portions 2, said thickened portion being provided with an undercut edge 12*a* extended transversely of the handle portion 2. The other handle portion 3 is at its free second end 3*b* provided with a bevelled terminal edge 13 and is made so much shorter than the handle portion 2 that its bevelled edge 13 may be snapped-in under the undercut edge 12*a* of the thickened portion 12 for additional uniting locking of the handle portions to each other. In order to hold the handle portions together in the most efficient way this auxiliary locking 11 should be positioned adjacent the free second ends 2*b*, 3*b* of the handle portions, but apart from that the auxiliary locking may naturally be carried out in different alternative manners. Thus, although it would mean additional costs, it would also be possible for instance to make handle portions having the same length and to force a restraining sleeve over the handle portions after folding the same.

The installation of an interdental brush 7 in the handle 1 according to the illustrated embodiment is carried out in the following manner. When the handle is in the flat unfolded condition illustrated in FIG. 1 the shaft portion 7*a* of the brush 7 is inserted through the bore 5 so that the bristle portion 7*b* of the brush 7 is placed in a suitable position in relation to the handle. Then the folding of the handle portions 2, 3 is commenced, and during the folding it should be observed that the shaft portion 7*a* comes in its right position between the pegs 9 on the handle portion 2. During the final phase of the folding the pegs 9 will be inserted into the recesses 10 in the other handle portion 3 in order to guide the handle portions towards a correct mutual position and in order to provide a certain locking, whereby the final locking together of the handle portions takes place during the last phase of the folding, when the bevelled terminal edge 13 of the handle portion 3 is snapped-in under the undercut edge 12*a* of the thickened portion 12. Finally the position of the bristle portion 7*b* in relation to the handle may, as has been mentioned above, possibly be adjusted by screwing in or unscrewing the brush 7.

A specific advantage of the handle of the invention is that it may very well be used for brushes having differently dimensioned shaft portions, and this means that one and the same handle may be used for a set of brushes of different size. Within reasonable limits the size of the bore 5 then forms the only restriction, i.e. provided that the shaft portion of the brush is not thicker than the bore 5 the brush may be efficiently retained in the handle.

One embodiment of the invention has been described above, and this embodiment is especially preferable in the regard that it is easy and inexpensive to manufacture, but it should be understood that the invention is not restricted to this embodiment but also covers modifications and variations thereof which are obvious to a man skilled in the art. Thus, it is for instance possible to manufacture the handle portions and the folding joint from different materials and to connect them in a suitable manner. It is also quite possible to provide the folding joint in the shape of a hinge, and in this case it should only be kept in mind that a central opening must remain for the introduction of the shaft portion of the brush. The gripping means intended to lock the shaft portion of the brush axially may likewise be designed alternatively, for instance in the shape of protrusions provided on those sides of the handle portions which face each other when the handle portions are folded, said protrusions engaging the shaft portion.

Naturally it is likewise possible to use the handle for other types of brushes or pencil brushes not having a shaft portion formed by twisted wires, and in this respect the only condition is that the brush or pencil brush comprises an elongated shaft portion that may be inserted into the handle and that may be retained therein.

In view of the above it is obvious that the invention is in no way restricted to the illustrated embodiment and that the scope of the invention is determined only by the enclosed patent claims.

We claim:

1. A handle for receiving a replaceable brush which brush consists of a single elongated shaft portion and an opposite brush portion, comprising:

a relatively stiff first handle portion having a first surface extending along a first axis between a first end and an opposite second end;

a relatively stiff second handle portion having a first surface extending along a second axis between a first end and an opposite second end;

a folding joint including a joint surface which extends from said first end of said first handle portion to said first end of said second handle portion, said first surface of said first handle portion and said first surface of said second handle portion being foldable towards and away from each other about said folding joint to a closed and an open position, respectively, said joint surface being relatively flexible and having an aperture extending therethrough dimensioned for receiving said single elongated shaft portion of said brush; and means associated with said folding joint for gripping said elongated shaft portion, when said elongated shaft portion is inserted through said aperture, to prevent movement of said brush in the direction of said first axis and said second axis when said first surface of said first handle and said first surface of said second handle are folded in said closed position, said means being formed by a terminal edge of said aperture and including upwardly from said aperture towards said first surface and a second set of steps extending upwardly from said aperture towards said second surface, said elongated shaft portion being gripped between corresponding edges of corresponding steps of said first set of steps and said second set of steps when said elongated shaft portion is inserted through said aperture and said first surface of said first handle and said first surface of said second handle are folded in said closed position.

2. The handle of claim 1 wherein said folding joint is integral with said first handle portion and said second handle portion.

3. The handle of claim 2 wherein said aperture includes a length which widens conically away from said first surface and said second surface.

4. The handle of claim 1 wherein said first surface and said second surface each include means for guiding said first handle portion and said second handle portion to the correct mutual position when said first surface of said first handle and said first surface of said second handle are folded in said closed position.

5. The handle of claim 4 wherein said guiding means includes pairs of protuberances which extend from said first surface of said first handle portion and complementary pairs of apertures which extend into said first surface of said second handle, said pairs of protuberances being disposed to straddle said single elongated shaft and enter said corresponding pairs of apertures when said elongated shaft portion is inserted through said aperture and said first surface of said first handle and said first surface of said second handle are folded in said closed position.

6. The handle of claim 1 wherein said first handle and said second handle are provided with locking means for holding said first handle together with said second handle when said first surface of said first handle and said first surface of said second handle are folded in said closed position.

7. The handle of claim 6 wherein said locking means is said pairs of protuberances and said complementary pairs of apertures.

8. The handle of claim 6 wherein said locking means includes complementary, snap-in means positioned at said opposite second end of said first handle and said opposite second end of said second handle.

9. The handle of claim 1 wherein said first handle portion and said second handle portion are each tapered from a respective narrow portion at a respective first end to a respective wider portion at a respective opposite second end.

* * * * *